US005901693A

United States Patent [19]

Smith

[11] Patent Number: 5,901,693

[45] Date of Patent: May 11, 1999

[54] TOY GUN HAVING AN OFFSET PROJECTILE LAUNCH AND TRANSPARENT VIEWFINDING PLUNGER

[75] Inventor: Joseph J. Smith, Cincinnati, Ohio

[73] Assignee: Hasbro, Inc., Pawtucket, R.I.

[21] Appl. No.: 08/956,173

[22] Filed: Oct. 22, 1997

[51] Int. Cl.[6] ..... F41B 11/14

[52] U.S. Cl. ..... 124/66; 124/67

[58] Field of Search ..... 124/65, 66, 67

[56] References Cited

U.S. PATENT DOCUMENTS

| | | | |
|---|---|---|---|
| D. 295,058 | 4/1988 | Turner, Jr. | D21/146 |
| D. 306,304 | 2/1990 | Tichy | D16/130 |
| D. 337,796 | 7/1993 | Sutyak | D21/145 |
| 2,145,277 | 8/1939 | Reardon | 46/195 |
| 2,214,224 | 9/1940 | Douglas | 124/15 |
| 3,262,440 | 7/1966 | Kuhn | 124/15 |
| 3,267,600 | 8/1966 | Ryan | 46/175 |
| 3,397,484 | 8/1968 | Ryan et al. | 46/175 |
| 3,441,270 | 4/1969 | Nielsen | 272/8 |
| 3,869,825 | 3/1975 | Heberlein | 46/219 |
| 4,294,445 | 10/1981 | Crosbie | 272/8 M |
| 4,625,706 | 12/1986 | Turner, Jr. | 124/67 |
| 5,242,323 | 9/1993 | Rappaport | 446/180 |
| 5,267,549 | 12/1993 | Webber | 124/65 |
| 5,323,755 | 6/1994 | Hsieh | 124/66 |
| 5,343,850 | 9/1994 | Steer | 124/64 |
| 5,373,832 | 12/1994 | D'Andrade | 124/69 |
| 5,375,847 | 12/1994 | Fromm et al. | 273/310 |
| 5,377,655 | 1/1995 | Arad | 124/65 |
| 5,535,729 | 7/1996 | Griffin et al. | 124/66 |
| 5,605,140 | 2/1997 | Griffin | 124/59 |
| 5,701,878 | 12/1997 | Moore et al. | 124/67 |
| 5,711,285 | 1/1998 | Stewart et al. | 124/67 |
| 5,715,802 | 2/1998 | Moore et al. | 124/66 |

*Primary Examiner*—J. Woodrow Eldred

*Attorney, Agent, or Firm*—Marshall, O'Toole, Gerstein, Murray & Borun

[57] ABSTRACT

A toy gun for launching a foam projectile from a launch station that is offset from the axis of the launcher. The gun includes a pneumatic launcher having a retractable plunger that reciprocates in a cylinder to define a compression chamber. One or more air ports are provided to communicate air from the compression chamber to the launch station in order to eject a projectile therefrom. The plunger incorporates a hollow shaft having transparent ends which are aligned with the transparent compression chamber, thus providing a continuous line of sight through said shaft and the compression chamber for aiming the gun toward an intended target.

19 Claims, 6 Drawing Sheets

TOY GUN HAVING AN OFFSET PROJECTILE LAUNCH AND TRANSPARENT VIEWFINDING PLUNGER

FIELD OF THE INVENTION

The present invention relates generally to a toy gun for launching a foam projectile. More specifically, the present invention relates to a toy gun that uses a spring-loaded plunger to pneumatically launch a soft foam projectile from a launching station that is offset from the axis of the plunger mechanism. Further, the plunger mechanism is transparent, and thus forms a transparent scope or viewfinder through which the user can aim the projectile towards an intended target.

BACKGROUND OF THE INVENTION

Toy guns are generally well known in the art. It is widely accepted that the most popular toy guns are those guns which actually launch a projectile because such guns satisfy a child's desire for realism. Of the projectile launching guns, those which launch soft foam projectiles are especially desirable, because the projectiles are durable and extremely safe. These guns typically include a spring-loaded reciprocating plunger which launches the projectile or dart using a blast of air.

However, the attention span of a typical child is relatively limited. Accordingly, many attempts have been made to enhance the play value of toys in general, and toy guns in particular. For example, multi-concept toys are becoming increasingly popular, such as toys that convert from an action figure into a vehicle, or toys that convert from an innocent looking object such as a radio or a camera into a weapon. Some toy guns have been adapted to launch more then one type of projectile, or to launch projectiles in two directions simultaneously. Still other toy guns have been modified to separate into two or more separate weapons.

Today's child apparently is drawn to those toy guns that are increasingly complex and realistic, and which incorporate or appear to incorporate futuristic elements. For example, some toy guns are popular simply because they have a space age appearance, which stimulates the child's imagination into thinking he or she is playing with a laser or ray gun. Some toys guns are popular because they incorporate additional features such as sights, light sources, sound effects, or magazines capable of holding extra ammunition. Accordingly, there is a continuing need for increasingly complex and futuristic toy guns that will enhance the toy's play value and that will stimulate a child's imagination.

SUMMARY OF THE INVENTION

The present invention incorporates the safety of a pneumatic soft foam projectile launcher or gun with a number of complex and futuristic features that greatly enhance the play value of the toy. The toy gun of the present invention uses a launch station or chamber that is offset from the axis of the plunger and the compression chamber, and the plunger forces the blast of air form the chamber through a small port in order to eject the projectile or dart from the gun. The plunger shaft is tubular and transparent, and includes a viewfinder on one end, and the end of the compression cylinder is also transparent. This offset construction, in conjunction with the transparent plunger and compression chamber, permits the plunger mechanism to double as a viewfinder or sight. Thus, in the hands of a child the present toy gun conjures up an image of a very modern, high-technology weapon having a complicated optical target acquisition system.

DETAILED DESCRIPTION OF THE PREFERRED EMBODIMENT

Figure 1:
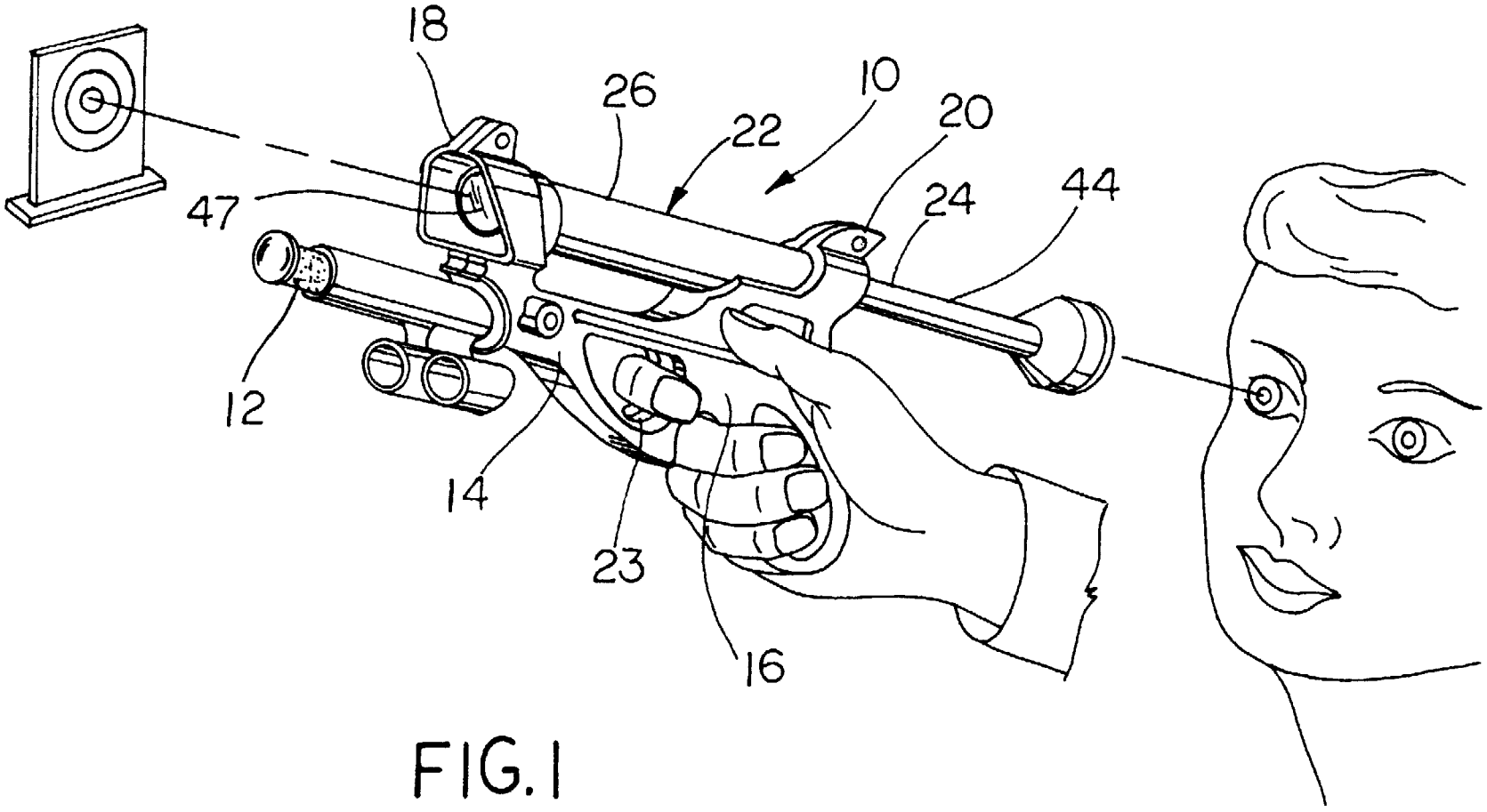
FIG. 1 is a perspective view of the toy air gun according to the present invention shown in the cocked position and held by a user viewing an intended target through the viewfinder.

The embodiment described herein is not intended to be exhaustive or to limit the scope of the invention to the precise form disclosed. The following embodiment has been chosen and described in order to best explain the principles of the invention and to enable others skilled in the art to follow its teachings.

Referring now to the drawings, a toy gun incorporating the features of the present invention is generally referred to by the reference numeral 10. Gun 10 is typically used to launch a soft foam projectile or dart 12. Gun 10 includes a body 14 having a handle 16 and forward and rearward ends 18, 20, respectively. A pneumatic launcher assembly 22 is carried by body 14, and includes a reciprocating plunger 24 housed in a cylinder 26 in a manner commonly employed in the art. A trigger assembly 23 is disposed in an opening in body 14 and engages a portion of plunger 24 as will be outlined in greater detail below.

Figure 3:
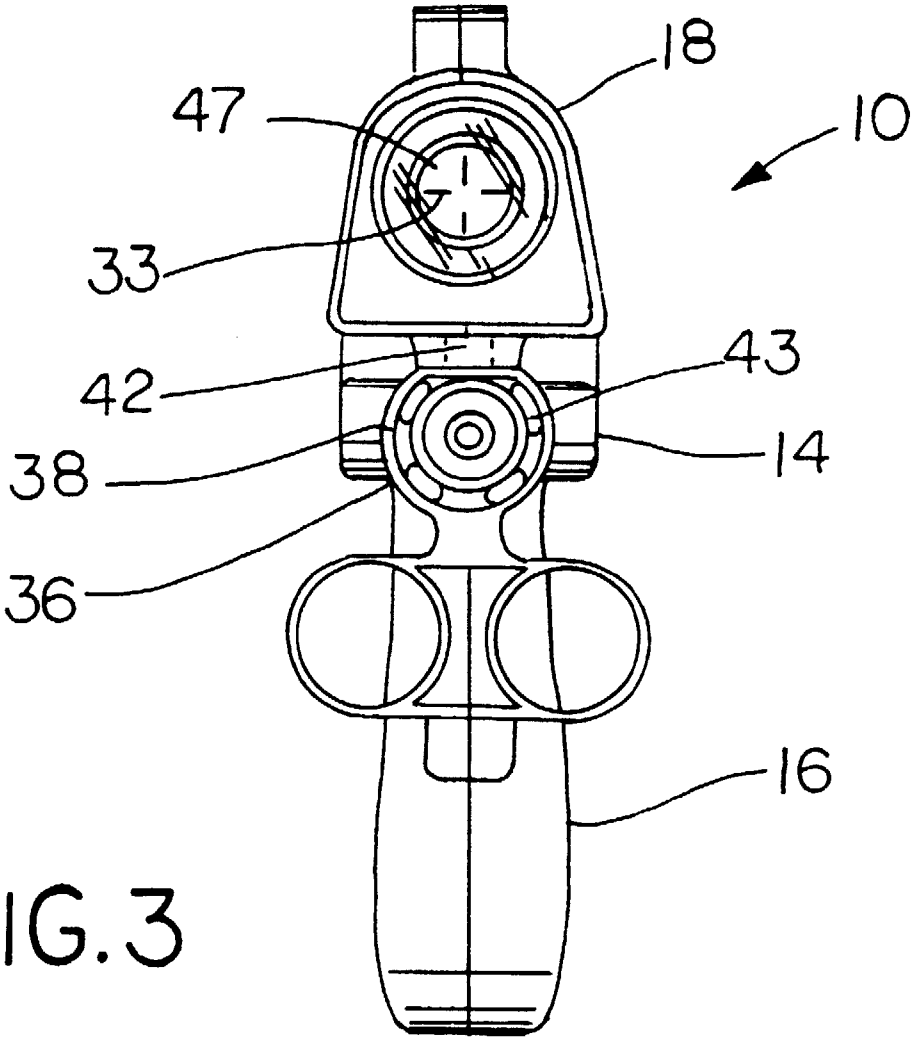
FIG. 3 is a front elevational view illustrating the annular air opening within the launch chamber and sighting indicia imprinted on the transparent viewfinder.
Figure 4:
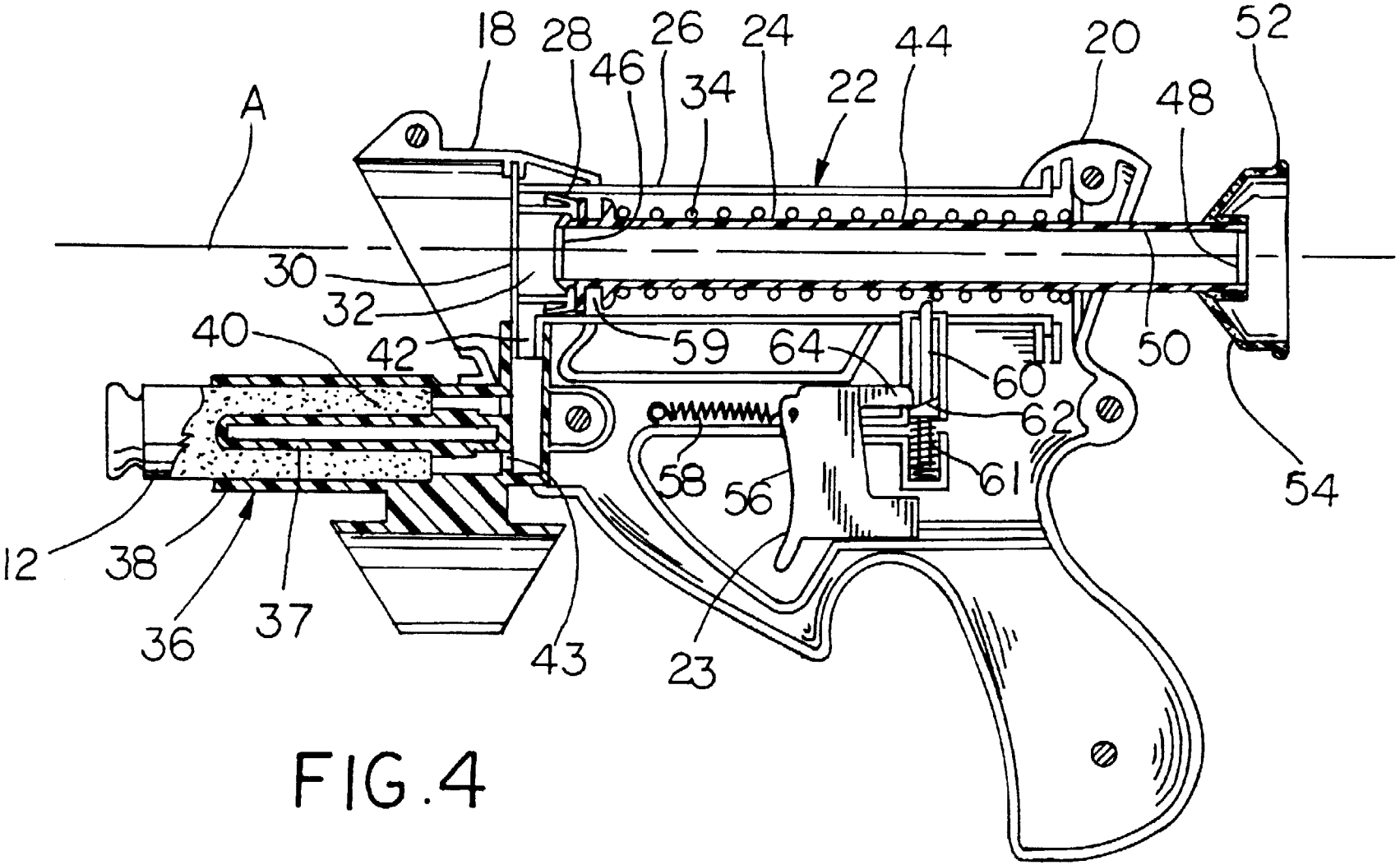
FIG. 4 is a cross-sectional view of the toy air gun shown in FIGS. 1 through 3 illustrating the plunger of the pneumatic launcher in the uncocked position.
Figure 5:
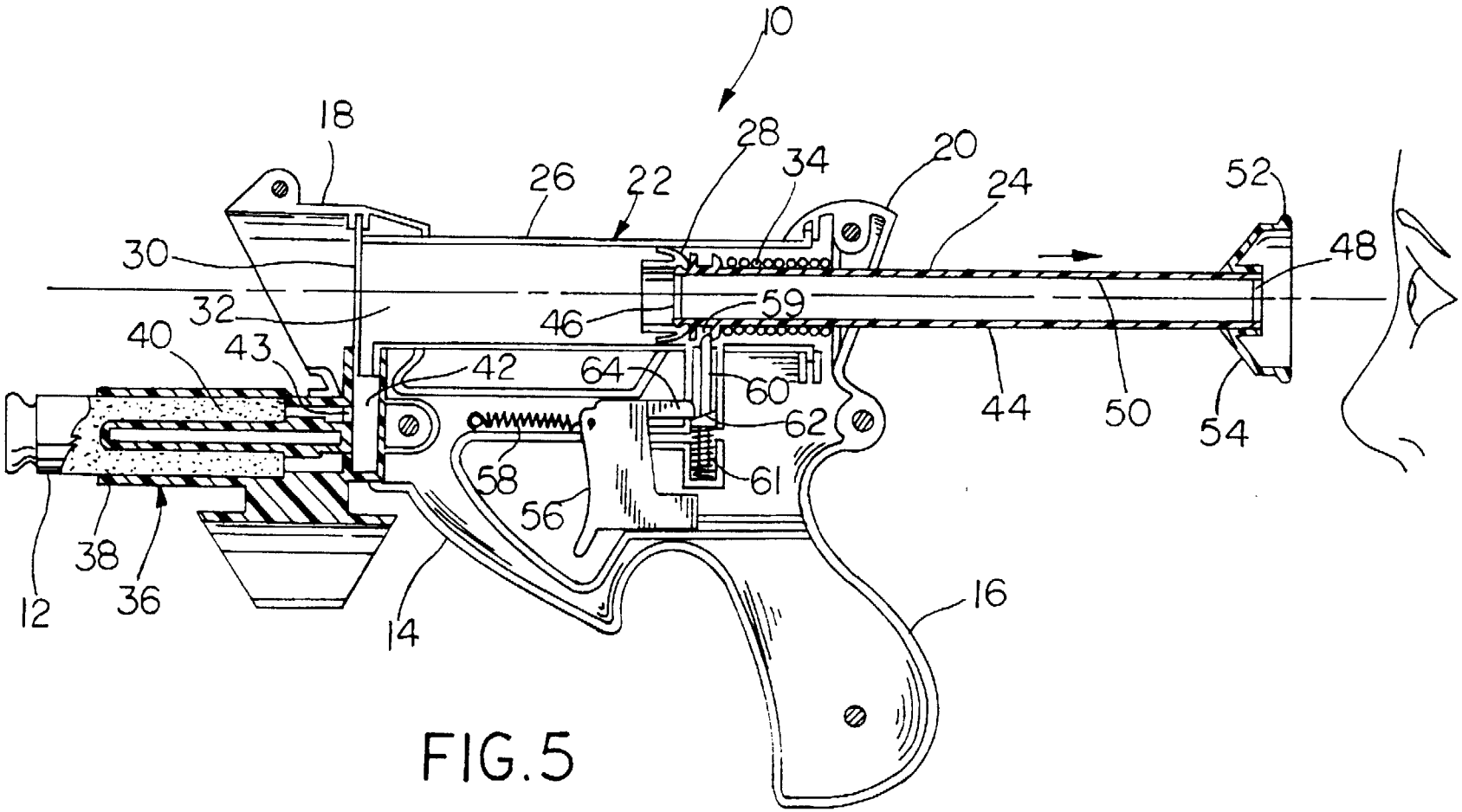
FIG. 5 is a cross-sectional view similar to that shown in FIG. 4 but illustrating the plunger of the pneumatic launcher in the retracted or cocked position.
Figure 6:
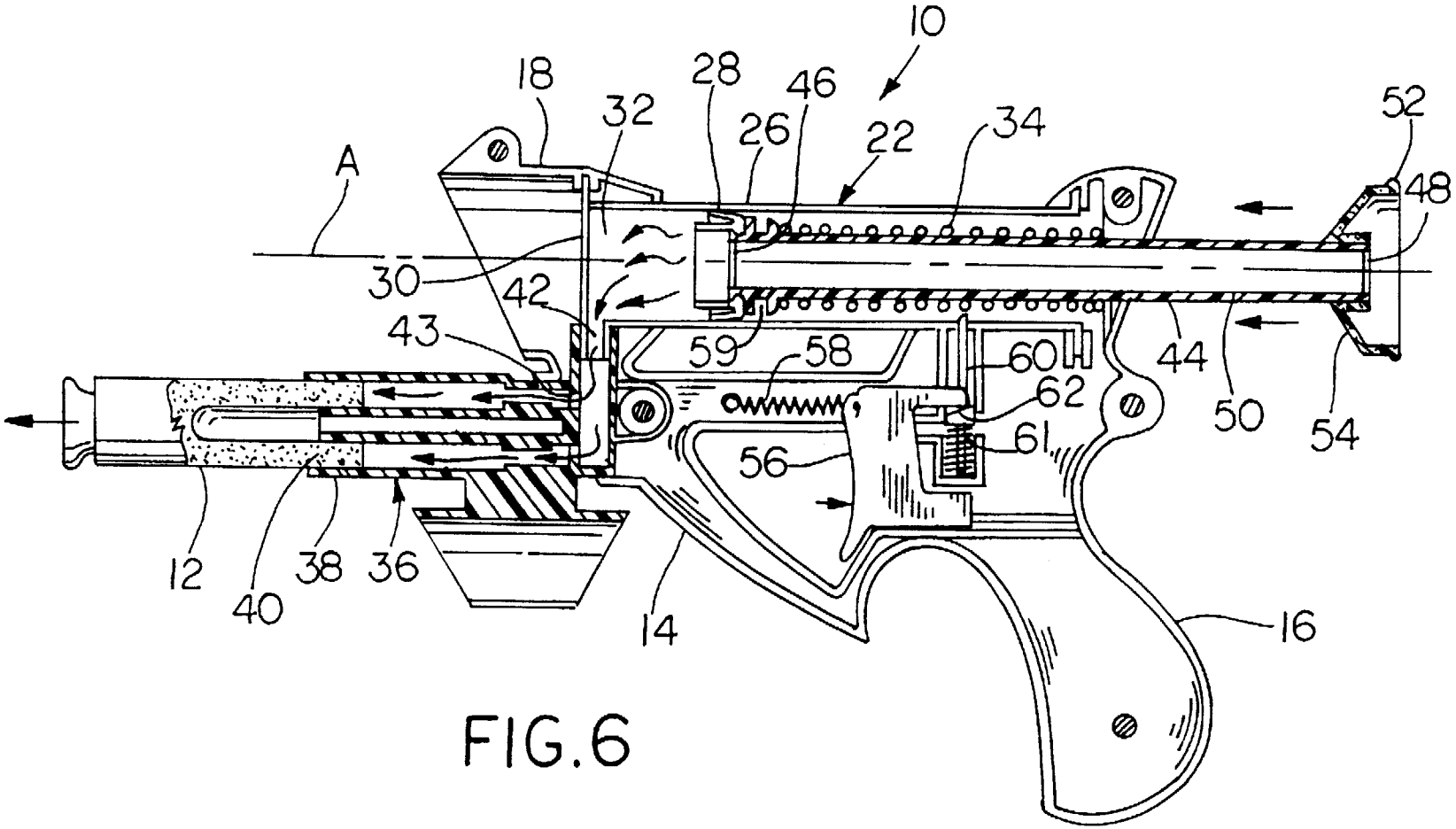
FIG. 6 is a cross-sectional view similar to FIGS. 4 and 5 and illustrating the plunger advancing and forcing air through the air port to the offset launch chamber to eject the foam dart.

As shown in FIGS. 4 through 6, plunger 24 includes a seal 28, which cooperates with the forward end 30 of cylinder 26 to define a compression chamber 32. A spring 34 is disposed within cylinder 26 behind and abutting the seal 28, which forwardly urges or biases plunger 24 toward the forward end 30 of cylinder 26. Spring 34 is preferably a compression coil spring which advances the plunger 24 within cylinder 26 in order to launch the dart 12. Alternatively, the spring 34 may be dispensed with, and the plunger 24 can be advanced manually. Forward end 30 of cylinder 26 is transparent, and as shown in FIG. 3 forward end 30 may include indicia or markings 33 thereon in order to simulate a viewfinder or scope.

A launch station 36 having a cylindrical launch tube 38 is mounted to body 14 below and offset from the longitudinal axis of launcher assembly 22. Although launch station 36 is shown in the Figures as being downwardly offset, it will be understood that the launch station 36 could be offset above or to either side of the launcher assembly 22. Launch tube 38 is sized and shaped to receive therein the end 40 of dart 12. Launch station 36 preferably includes a peg or post 37 which engages a bore (not shown) in the rear end 40 of dart 12 for stabilizing the dart within the tube 38. A channel or port 42 extends through a portion of body 14 to provide flow communication between compression chamber 32 and launch station 36. As shown in FIG. 3, port 42 terminates in a ring-shaped exit aperture 43 in order to more evenly distribute the air to the end 40 of dart12.

Figure 2:
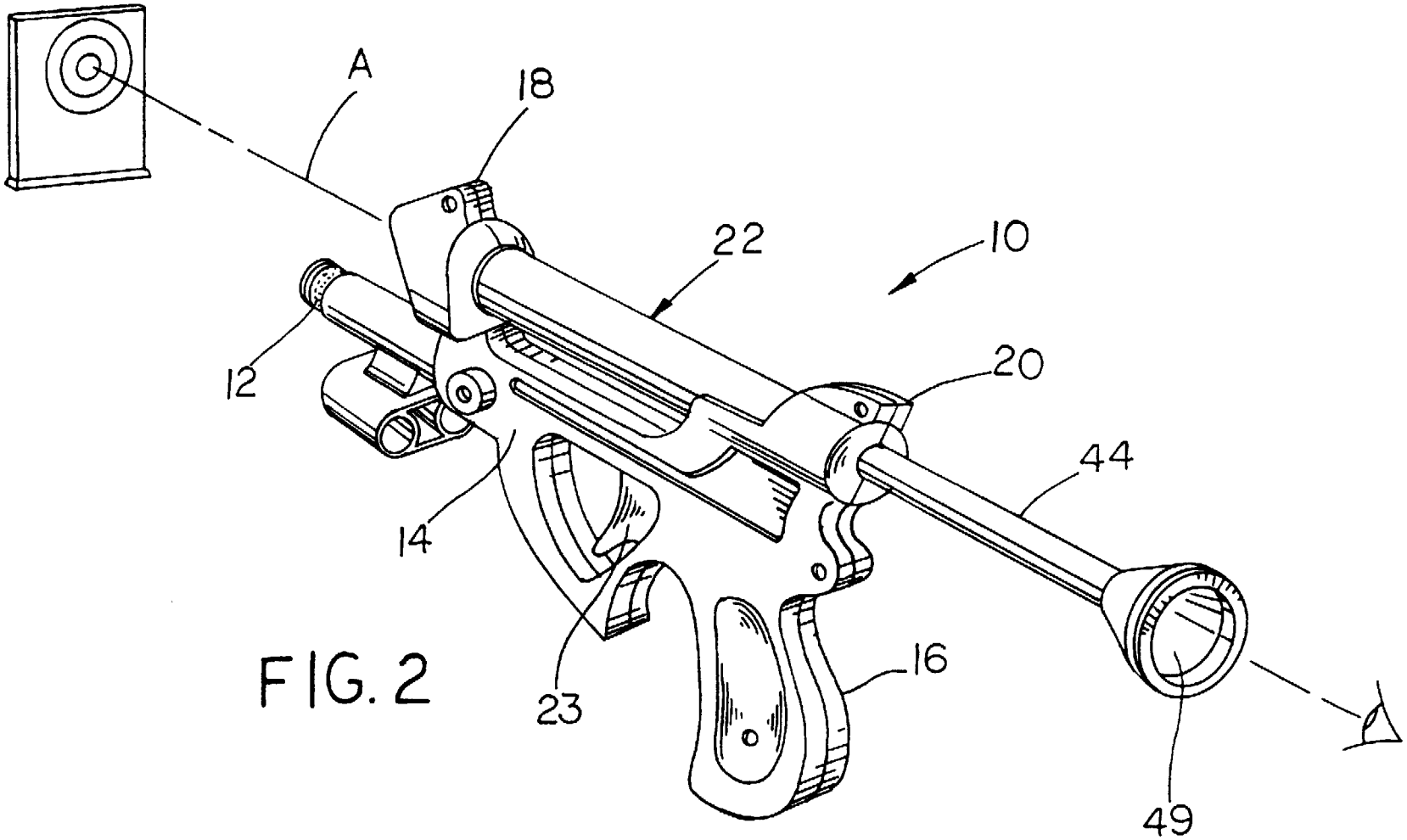
FIG. 2 is a perspective view taken from the rear of the toy gun.

Referring now to FIGS. 4 through 6, plunger 24 includes a shaft 44 having forward and rearward ends 46, 48, respectively, and a longitudinal bore 50 extending therethrough. As shown in FIGS. 1 through 3, both forward end 46 and rearward end 48 are transparent, so that a continuous line of sight generally indicated by the reference arrow A is provided through the rearward end 48 of shaft 44, through bore 50 and forward end 46, and through forward end 30 of cylinder 26. Bore 50 is preferably circular, so that forward end 47 defines a generally circular viewfinder as shown in FIG. 1, while rearward end 49 similarly defines a generally circular viewfinder 49 as shown in FIG. 2.

As shown in FIGS. 4 through 6, seal 28 is mounted adjacent forward end 46 of shaft 44 in an annular fashion so as not to interrupt the line of sight A. A conical cup or viewing piece 52 is attached to rearward end 48. Viewing piece 52 includes a stiffened handle portion 54 which can be used to draw the plunger from the uncocked position shown in FIG. 4 to the cocked position shown in FIG. 5. As stated above, forward end 30 may include markings or indicia 33 thereon in order to further simulate an actual viewfinder or scope.

Trigger assembly 23 includes a finger pull 56 which is forwardly biased within body 14 by a tension spring 58. The forward end 46 of shaft 44 includes a notch 59 which engages a latch pin 60 of trigger assembly 23. Latch pin 60 is upwardly biased within body 14 by a spring 61, and latch pin 60 engages notch 59 when the gun is in the cocked position shown in FIG. 5. Latch pin 60 includes a camming surface 62 which is contacted by an arm 64 extending from finger pull 56, so that upon rearward motion of finger pull 56 arm 64 cams against camming surface 62, thus drawing the latch pin 60 downwardly out of contact with the notch 59 in seal 28. When latch pin 60 disengages the notch 59, the forward motion of plunger 24 commences.

In operation, a user (not shown) places the dart 12 in the launch tube 38 of launch station 36 with the post 37 engaging the bore (not shown) in the rearward end 40 of dart 12. The user then draws the plunger 24 of launcher assembly 22 using the handle portion 54 at the rearward end 48 of shaft 44. Air is drawn into the compression chamber via the exit aperture 43 in launch tube 38 and through port 42 into compression chamber 32. The rearward motion of plunger 24 compresses spring 34. When the plunger 24 reaches the fully retracted or cocked position as shown in FIG. 4, the latch pin 60 engages the notch 59 at the forward end 46 of shaft 44. The gun 10 is now in condition to launch the dart 12.

The user next aims the gun at an intended target by looking along the line of sight A until the intended target is visible as shown in FIGS. 1 and 2. The aiming process is aided by manipulating the gun 10 so that the intended target is visible through the circular viewfinder 47 and 49. When the user is satisfied that the gun has been aimed properly, the finger pull 56 is pulled rearwardly against the force of spring 58, and the arm 64 acts against the camming surface 62 to draw the latch pin 60 out of contact with notch 59. The force of spring 34 against the seal 28 accelerates the plunger 24 forwardly towards end 18 of gun 10.

As the plunger 24 moves forwardly, air or gas contained within the compression chamber 32 is quickly forced through the port 42 into the launch station 36 via exit aperture 43 as can be seen in FIG. 6. The resulting blast or charge of air against the rearward end 40 of dart 12 ejects the dart 12 from the launch tube 38 towards the intended target. The gun 10 is now in the uncocked position ready to be re-loaded and re-fired.

It will be understood that the above description does not limit the invention to the above-given details. It is contemplated that various modifications and substitutions can be made without departing from the spirit and scope of the following claims.

What is claimed:

1. A toy gun for launching a foam projectile, comprising:

a body having a handle, forward and rearward ends, and a trigger mechanism;

a pneumatic launcher having a plunger and a compression chamber, said plunger being shiftable along a longitudinal axis between a retracted position and a forward position, said plunger being adapted to be releasably retained in said retracted position by said trigger mechanism, said plunger further including a shaft having a longitudinal bore extending therethrough and transparent rearward and forward ends, said compression chamber including a transparent forward end, said bore and said compression chamber forward end thereby defining an aiming line of sight through said gun;

a launch chamber having a longitudinal axis offset from said compression chamber axis; and an air port for providing flow communication between said compression chamber and said launch chamber;

thereby permitting the launching of a projectile placed adjacent said launch chamber as said plunger shifts towards the forward position upon actuation of said trigger mechanism.

2. The toy gun as claimed in claim 1, wherein said shaft rearward end includes a generally conical viewing piece.

3. The toy gun as claimed in claim 1, wherein said plunger includes a rearward end, and a handle attached to said rearward end for drawing said plunger towards the retracted position.

4. The toy gun as claimed in claim 1, wherein said shaft forward end includes a circular viewfinder, said viewfinder for aiding a user in aligning the line of sight with a target.

5. The toy gun as claimed in claim 1, wherein said shaft rearward end includes a circular viewfinder, said viewfinder for aiding a user in aligning the line of sight with a target.

6. The toy gun as claimed in claim 1, wherein each of said shaft forward and rearward ends includes a circular viewfinder, said viewfinder for aiding a user in aligning the line of sight with a target.

7. The toy gun as claimed in claim 1, wherein said launch chamber is cylindrical and sized to receive the projectile and includes a rearward end having a ring shaped aperture in flow communication with said port.

8. The toy gun as claimed in claim 1, wherein said compression chamber and said launch chamber are cylindrical, the axis of said launch chamber being parallel to the axis of said compression chamber, and further wherein said line of sight is parallel to the axis of said launch chamber.

9. A toy gun for launching a projectile, comprising:

a body having a forward end for receiving the projectile and a handle having a trigger mechanism;

a cylindrical compression chamber mounted to the body, the compression chamber having a transparent forward end;

a forwardly biased plunger reciprocally disposed in said compression chamber, said plunger including a hollow shaft having a transparent forward end and a transparent rearward end, said shaft ends and said compression chamber end thereby defining a line of sight through the gun, said plunger being shiftable between a retracted position in which said plunger engages and is releasably retained by the trigger and a forward position, the plunger being releasably retained in said retracted position by said trigger mechanism;

a launch chamber offset from said compression chamber, said launch chamber being sized to receive the projectile; and an air port providing flow communication between said compression chamber and said launch chamber;

so that upon actuation of the trigger mechanism compressed air flows into said launch chamber thereby launching the projectile.

10. The gun as claimed in claim 9, wherein said shaft rearward end includes a conical viewing piece.

11. The gun as claimed in claim 9, wherein said plunger includes a rearward end, and a handle attached to said rearward end for drawing said plunger towards the retracted position.

12. The gun as claimed in claim 9, wherein said shaft forward end includes a circular viewfinder, said viewfinder for aiding a user in aligning the line of sight with a target.

13. The gun as claimed in claim 9, wherein said shaft rearward end includes a circular viewfinder, said viewfinder for aiding a user in aligning the line of sight with a target.

14. The gun as claimed in claim 9, wherein each of said shaft forward and rearward ends includes a circular viewfinder, said viewfinders for aiding a user in aligning the line of sight with a target.

15. The gun as claimed in claim 9, wherein said launch chamber includes a rearward end having a ring shaped aperture in flow communication with said port.

16. The gun as claimed in claim 9, wherein said compression chamber and said launch chamber are cylindrical, the axis of said launch chamber being parallel to the axis of said compression chamber, said line of sight being parallel to the axis of said launch chamber.

17. A toy gun for launching a projectile, comprising:

a body having a forward end for receiving the projectile and handle having a trigger mechanism;

a pneumatic launcher carried by said body and having a spring biased reciprocating plunger and a compression chamber, said plunger including a hollow shaft having a transparent forward and rearward ends, said compression chamber including a transparent forward end, said shaft ends and said compression chamber end thereby defining a line of sight through said launcher, said plunger being shiftable between a retracted position and a forward position, the plunger being releasably retained in said retracted position by said trigger mechanism;

a launch chamber sized to receive the projectile, said launch chamber being in flow communication with said pressure chamber;

so that upon actuation of the trigger mechanism air compressed in said compression chamber launches the projectile.

18. The gun as claimed in claim 17, wherein the axis of said launcher is offset from the axis of said launch chamber.

19. The gun as claimed in claim 17, wherein said compression chamber and said launch chamber are cylindrical, the axis of said launch chamber being parallel to the axis of said compression chamber, said line of sight being parallel to the axis of said launch chamber.

* * * * *

UNITED STATES PATENT AND TRADEMARK OFFICE

CERTIFICATE OF CORRECTION

PATENT NO. : 5,901,693

DATED : May 11, 1999

INVENTOR(S) : Joseph J. Smith

It is certified that error appears in the above-identified patent and that said Letters Patent is hereby corrected as shown below:

In claim 9, line 7, please delete "in which said plunger engages and is releasably retained by the trigger"

Signed and Sealed this

Nineteenth Day of October, 1999

*Attest:*

Q. TODD DICKINSON

*Attesting Officer*

*Acting Commissioner of Patents and Trademarks*